US009457878B1

(12) United States Patent
Schultz et al.

(10) Patent No.: US 9,457,878 B1
(45) Date of Patent: Oct. 4, 2016

(54) INVERTABLE PERSONAL FLOATATION DEVICE

(76) Inventors: Douglas James Schultz, Oakland Park, FL (US); Justin Rietema, Oakland Park, FL (US)

( * ) Notice: Subject to any disclaimer, the term of this patent is extended or adjusted under 35 U.S.C. 154(b) by 0 days.

(21) Appl. No.: 13/607,887

(22) Filed: Sep. 10, 2012

Related U.S. Application Data

(63) Continuation-in-part of application No. 13/416,882, filed on Mar. 9, 2012, now abandoned.

(51) Int. Cl.
*B63C 9/115* (2006.01)

(52) U.S. Cl.
CPC ..... *B63C 9/115* (2013.01)

(58) Field of Classification Search
CPC ..... B63C 9/15
USPC ..... 441/106, 111, 118, 115; 224/657
See application file for complete search history.

(56) References Cited

U.S. PATENT DOCUMENTS 6,089,936 A * 7/2000 Hoffman ..... B63C 9/115 441/117
6,328,618 B1 * 12/2001 Fleischli ..... B63C 9/093 2/456
6,379,208 B2 * 4/2002 Khanamirian ..... B63C 9/115 441/106
6,773,318 B1 * 8/2004 Albright ..... A41D 13/0125 441/118
7,182,662 B2 * 2/2007 O'Meara ..... B63C 9/1255 441/111
D552,206 S * 10/2007 Peterson ..... B63C 9/115 D21/804
2007/0062996 A1 * 3/2007 Miles ..... A45C 13/103 224/657

* cited by examiner

*Primary Examiner* — Lars A Olson
*Assistant Examiner* — Jovon Hayes
(74) *Attorney, Agent, or Firm* — Oltman, Flynn & Kubler

(57) ABSTRACT

An invertible floatation garment which alternately can be worn as shorts or as a vest includes a garment front sheet and a garment rear sheet which are laterally interconnected by lateral connecting segments to form a single tubular structure for fitting around the chest or trunk of a wearer. An upright forward slit opening is provided through the center of the front sheet to permit the garment to be opened so that the wearer can take the garment on and off, dividing the front sheet into a front sheet left portion and a front sheet right portion with closure fasteners. An front and rear sheet connecting segment narrower than the front and rear sheets defines on either side of it leg openings which become arm openings when the garment is inverted.

21 Claims, 15 Drawing Sheets

INVERTABLE PERSONAL FLOATATION DEVICE

This application is a continuation-in-part of application Ser. No. 13/416,882 filed on Mar. 9, 2012 now abandoned.

BACKGROUND OF THE INVENTION

1. Field of the Invention

The present invention relates generally to the field of floatation devices such as for safety. More specifically the present invention relates to a floatation garment which can be worn as a pair of shorts or inverted and worn as a life vest. The garment includes a garment front sheet and a garment rear sheet which are laterally interconnected by lateral connecting segments to form a single tubular structure with a vertical axis and formed of elastic material such as neoprene for fitting around the chest or trunk of a wearer. An upright forward slit opening is provided through the center of the front sheet to permit the garment to be opened so that the wearer can take the garment on and off, dividing the front sheet into a front sheet left portion and a front sheet right portion, with closure fasteners such as a garment zipper as well as first and second straps fastened to and wrapping around the garment and having opposing strap ends meeting at the middle of the front sheet and fastened with opposing and corresponding strap fasteners over slit opening.

The garment front sheet has a forward sheet portion with generally horizontal and spaced apart front first and second series, one above the other, of front buoyant member pockets, each of which each contain a front buoyant member the front garment sheet having a slightly arched front sheet first end tapering along a vertical direction to define its second end. The front sheet preferably terminates between the chest and abdominal area of the wearer so that the wearer is further unrestricted in bending at the waist.

The buoyant member first and second series permit the front sheet to bend along a horizontal line between the series to permit the wearer to bend forward at the waist. First and second sheet straps, respectively, extend laterally from the rear sheet around to the front sheet, and continue around the front sheet and have fastening mechanisms such as buckles or clasps at their free ends to connect to each other to form one belt.

The garment rear sheet also has generally horizontal first and second series of rear buoyant member pockets, one above the other each containing a rear buoyant member. The garment rear sheet has a sheet first end and tapers along a vertical direction from its second end and meets and connects to the tapered second end of the garment front sheet to define in combination a connecting segment which passes between the wearer legs when the garment is worn as shorts and preferably is integral with the front and rear sheets to define a single, continuous garment sheet.

Greater buoyancy is provided in the front sheet, to keep the wearer facing upward in the water. The upright buoyant members preferably are soft foam blocks or panels. The front and rear strap connection means preferably are 1.5 inch heavy duty coated nylon belts with durable quick release buckles.

As noted above, the front and rear panels are laterally interconnected by connecting segments. The connecting segments preferably are formed of elastic material.

The garment zipper preferably extends entirely along the upright front slit in front sheet and along an upright rear slit extending part way down rear sheet. An inventive multidirectional zipper track and two zipper tabs preferably are provided, such that the two zipper tabs can be advanced either toward each other to close the zipper or away from each other to open the zipper. Front and rear zipper tabs preferably are provided so that the front zipper tab and rear zipper tab can be pulled up to an extent that an open slit gap remains between the tabs defining a head passing opening when the garment is to be used in its vest mode. A zipper flap preferably is secured to front sheet and to rear sheet along one side of front and rear slits to lie laterally over the garment zipper and thereby shield the wearer from abrasive contact with the zipper.

2. Description of the Prior Art

There have long been floatation garments equipped with blocks or stacked panels of buoyant material contained between garment layers. These garments tend to be cumbersome and ill fitting and the buoyant blocks and panels tend to be bulky and awkward and to inhibit smooth and efficient movement of a wearer trying to swim.

Several patents appear to teach large blocks of buoyant material fitted to fixed and specific locations within the garments. Ikenaga, et al., U.S. Pat. No. 6,910,224, issued on Jun. 28, 2005 discloses an article of clothing with blocks of buoyant material sections fitted into pockets. Gilmer, U.S. Pat. No. 7,226,330 issued on Jun. 5, 2007 reveals a flotation swimsuit and method of construction of the swimsuit. Meredith, U.S. Pat. No. 5,459,874 issued on Oct. 24, 1995 teaches construction of floatation swimsuits into which foam pads can be inserted at a variety of fixed locations using a special tool. Michalochick, et al., U.S. Pat. No. 5,184,968, issued on Feb. 9, 1993, discloses floatation swim wear in the form of a one-piece swimsuit having a lower pants portion and a two-ply upper portion with a one-piece floatation member between plies of the swimsuit.

Other variations include Johnson, et al., U.S. Pat. No. 6,986,691, issued on Jan. 17, 2006, which teaches foam stabilization for a personal flotation device in the form of a flotation vest containing a series of layers of flexible foam material held together fabric bands, and Khanamirian, U.S. Patent Publication Number 2001/0051478, published on Dec. 13, 2001, which discloses a personal floatation device with adjusting flotation layers.

It is thus an object of the present invention to provide a floatation garment which form fits closely to the body and has buoyant members which are interconnected by elastic, bendable fabric, so that swimming movements of the wearer are free and uninhibited.

It is another object of the present invention to provide such a garment having buoyant members in the form of upright panels within elastic stretchable material to fit the body closely.

It is still another object of the present invention to provide another version of such a garment which is invertible to transform from a vest with arm openings to a pair of shorts with leg openings.

It is finally an object of the present invention to provide such a garment which is relatively inexpensive to manufacture and aesthetically pleasing.

SUMMARY OF THE INVENTION

The present invention accomplishes the above-stated objectives, as well as others, as may be determined by a fair reading and interpretation of the entire specification.

An invertible floatation garment which alternately can be worn as shorts or as a vest is provided, including a garment front sheet and a garment rear sheet which are laterally interconnected by lateral connecting segments to form a single tubular structure with a vertical axis and formed of elastic material such as spandex for fitting around the chest or trunk of a wearer. An upright forward slit opening is provided through the center of the front sheet to permit the garment to be opened so that the wearer can take the garment on and off, dividing the front sheet into a front sheet left portion and a front sheet right portion, with closure fasteners such as a garment zipper as well as first and second straps fastened to and wrapping around the garment and having opposing strap ends meeting at the middle of the front sheet and fastened with opposing and corresponding strap fasteners over slit opening.

The garment front sheet has a forward sheet portion with generally horizontal and spaced apart front first and second series, one above the other, of front buoyant member pockets, each of which each contain a front buoyant member the front garment sheet having a slightly arched front sheet first end tapering along a vertical direction to define its second end. The front sheet preferably terminates between the chest and abdominal area of the wearer so that the wearer is further unrestricted in bending at the waist.

The buoyant member first and second series permit the front sheet to bend along a horizontal line between the series to permit the wearer to bend forward at the waist. First and second sheet straps, respectively, and sewn to and extend from the garment rear sheet and wrap around the sides and then over the garment front sheet, and connect at the middle of the garment front sheet with fastening mechanisms such as buckles or clasps at the strap free ends.

The garment rear sheet also has generally horizontal first and second series of rear buoyant member pockets, one above the other each containing a rear buoyant member. The garment rear sheet has a sheet first end and tapers along a vertical direction from its second end and meets and connects to the tapered second end of the garment front sheet to define in combination a connecting segment which passes between the wearer legs when the garment is worn as shorts and preferably is integral with the front and rear sheets to define a single, continuous garment sheet.

BRIEF DESCRIPTION OF THE DRAWINGS

Various other objects, advantages, and features of the invention will become apparent to those skilled in the art from the following discussion taken in conjunction with the following drawings, in which:

FIG. 1 is a front view of a person wearing the garment oriented to function as a floatation vest.

FIG. 2 is a rear view of the person and garment of FIG. 1.

FIG. 3 is a front view of a person wearing the garment oriented to function as a pair of floatation shorts.

FIG. 4 is rear view of the person and garment of FIG. 3.

FIG. 5 is a four part illustration of the garment of FIGS. 1-4 being rotated and inverted to reveal front and rear views of the garment in both its vest and shorts orientations.

FIG. 6 is a side view of a person wearing the garment of FIGS. 1-5.

FIG. 7 is a close-up front view of the garment in its vest orientation.

FIG. 8 is a close-up rear view of the garment in its vest orientation.

FIG. 9 is a close-up front view of the garment in its shorts orientation.

FIG. 10 is a close-up rear view of the garment in its shorts orientation.

FIG. 11 is a side view of the garment in its vest orientation.

FIG. 12 is a broken away view of either of the first or second straps and its respective strap fastener in the form of a buckle.

FIG. 13 is a broken away view of a buoyant member in a front pocket.

FIG. 14 is a broken away view of one of the clips a clip straps.

FIG. 15 is a broken away view of the two opposing zippers in a single zipper track.

FIG. 16 is a side view of the second embodiment of the garment having its strap fasteners on the sides so that the garment can be opened to act as a seat, the garment shown being worn in its vest orientation on a person floating in water.

FIG. 17 is a side view of the second embodiment of the garment shown in FIG. 16 with the front and rear sheets opened away from each other to a 90 degree relationship relative to each other so that a person can float while seated in the garment as a chair.

FIG. 18 is a close-up side view of the second embodiment of the garment alone, oriented in its vest position.

FIG. 19 is a plan view of the second embodiment of the garment opened completely so that the front and rear sheets are essentially co-planar.

FIG. 20 is a close-up side view of the garment alone, opened into its chair configuration, so that a person can sit in the garment and float.

DETAILED DESCRIPTION OF THE PREFERRED EMBODIMENTS

Figure 1:
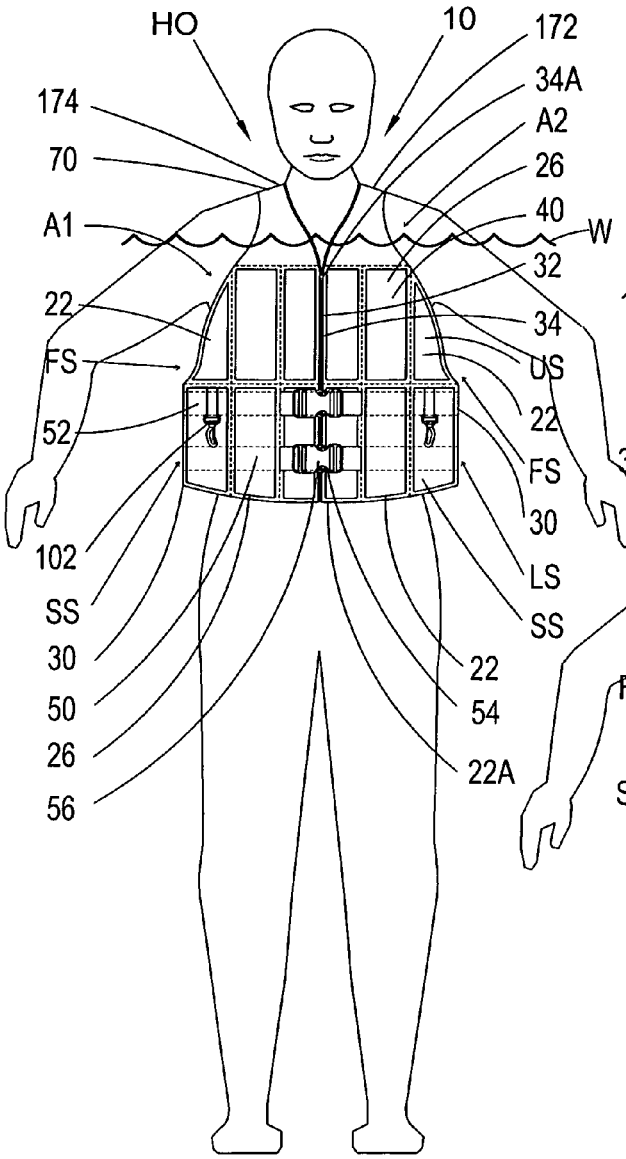
FIGS. 1-20 illustrate the first embodiment of the invertible floatation garment.
Figure 2:
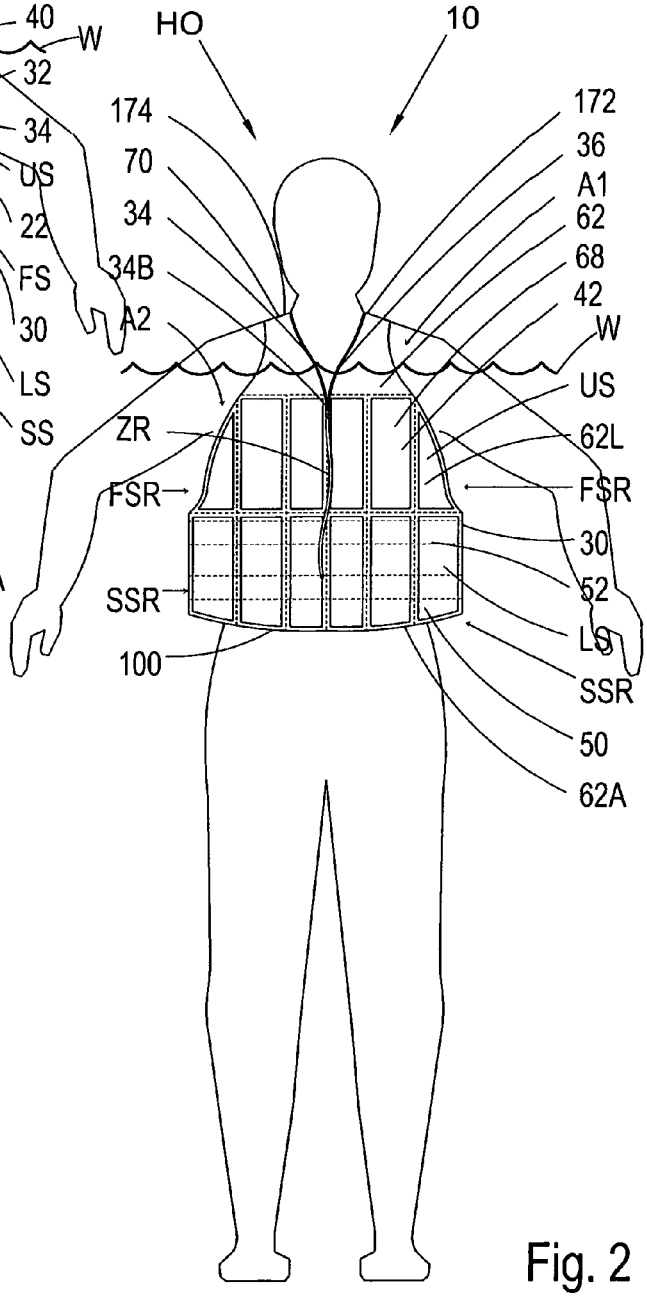
Figure 3:
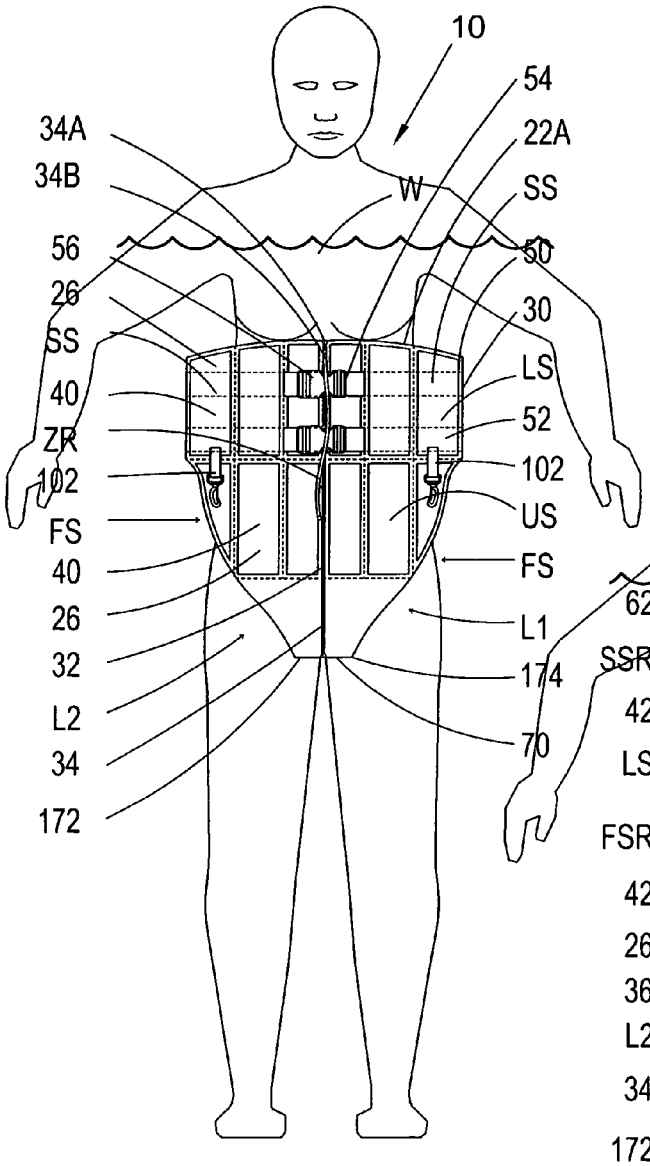
Figure 4:
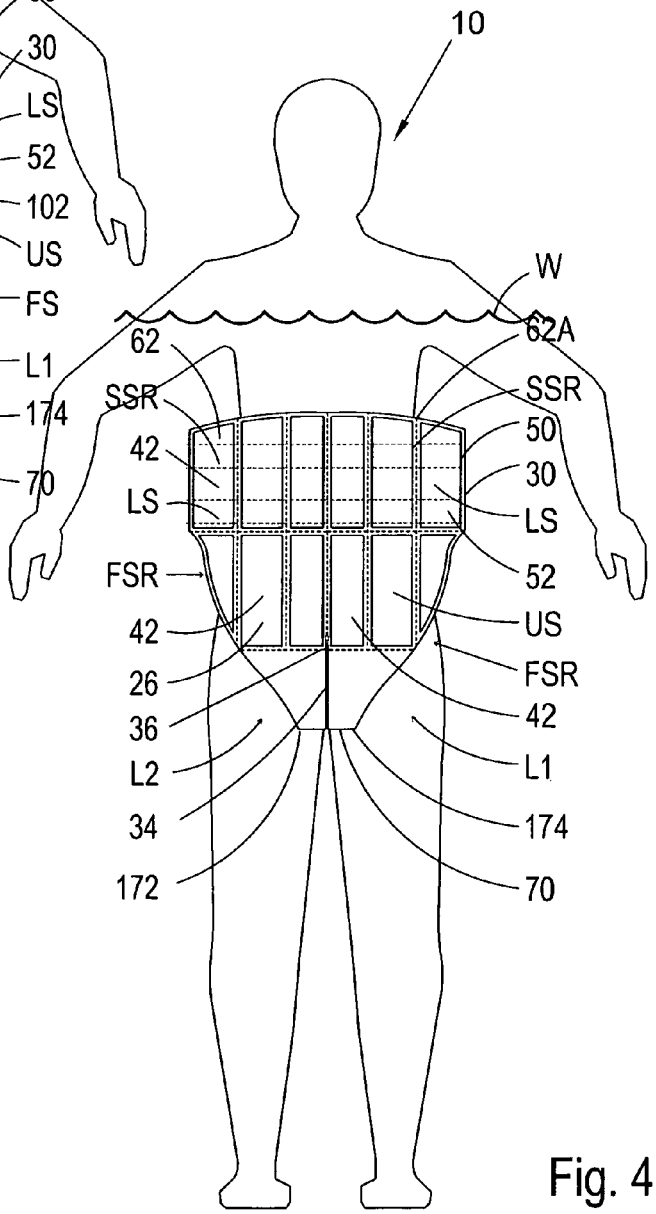
Figure 5:
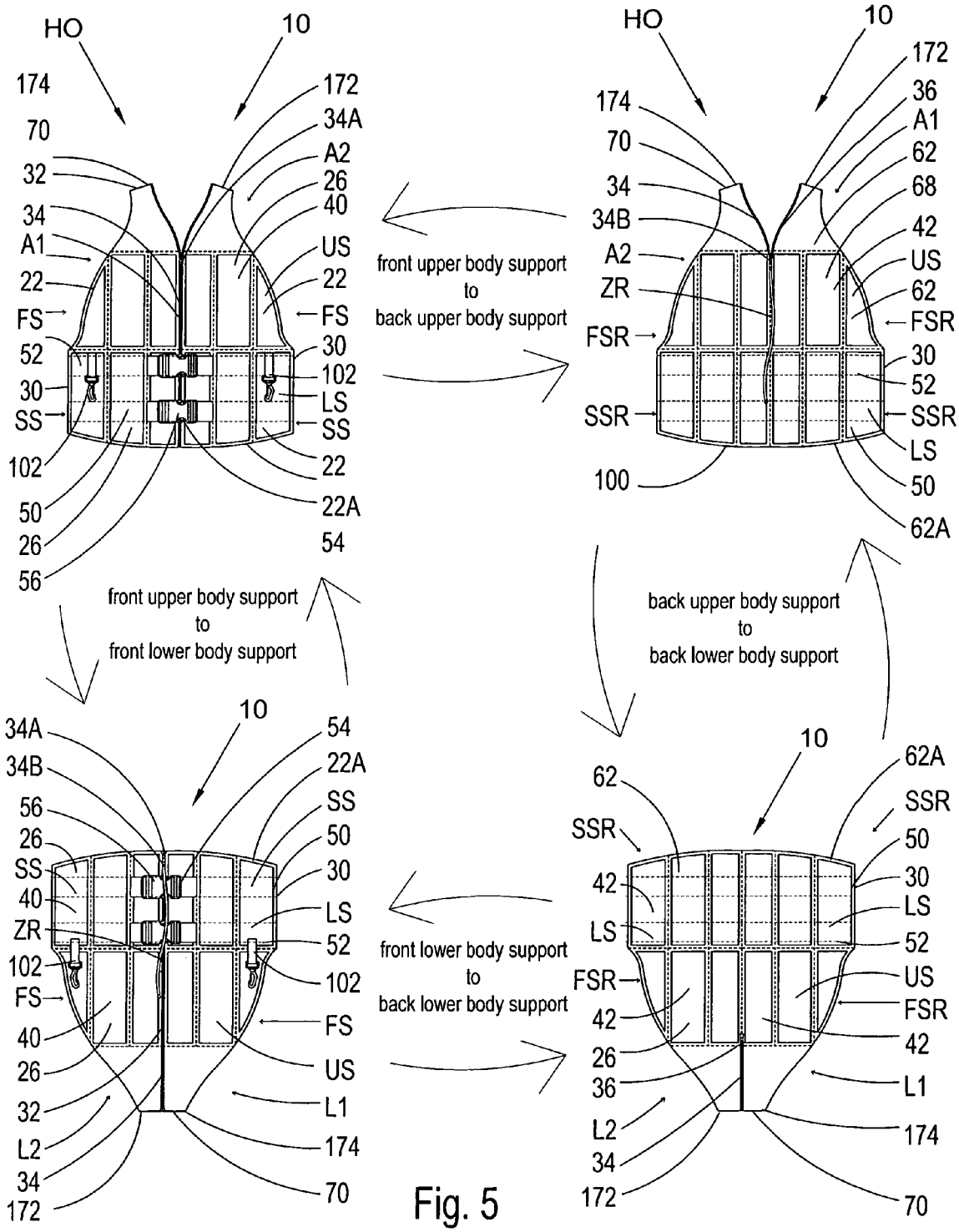
Figure 6:
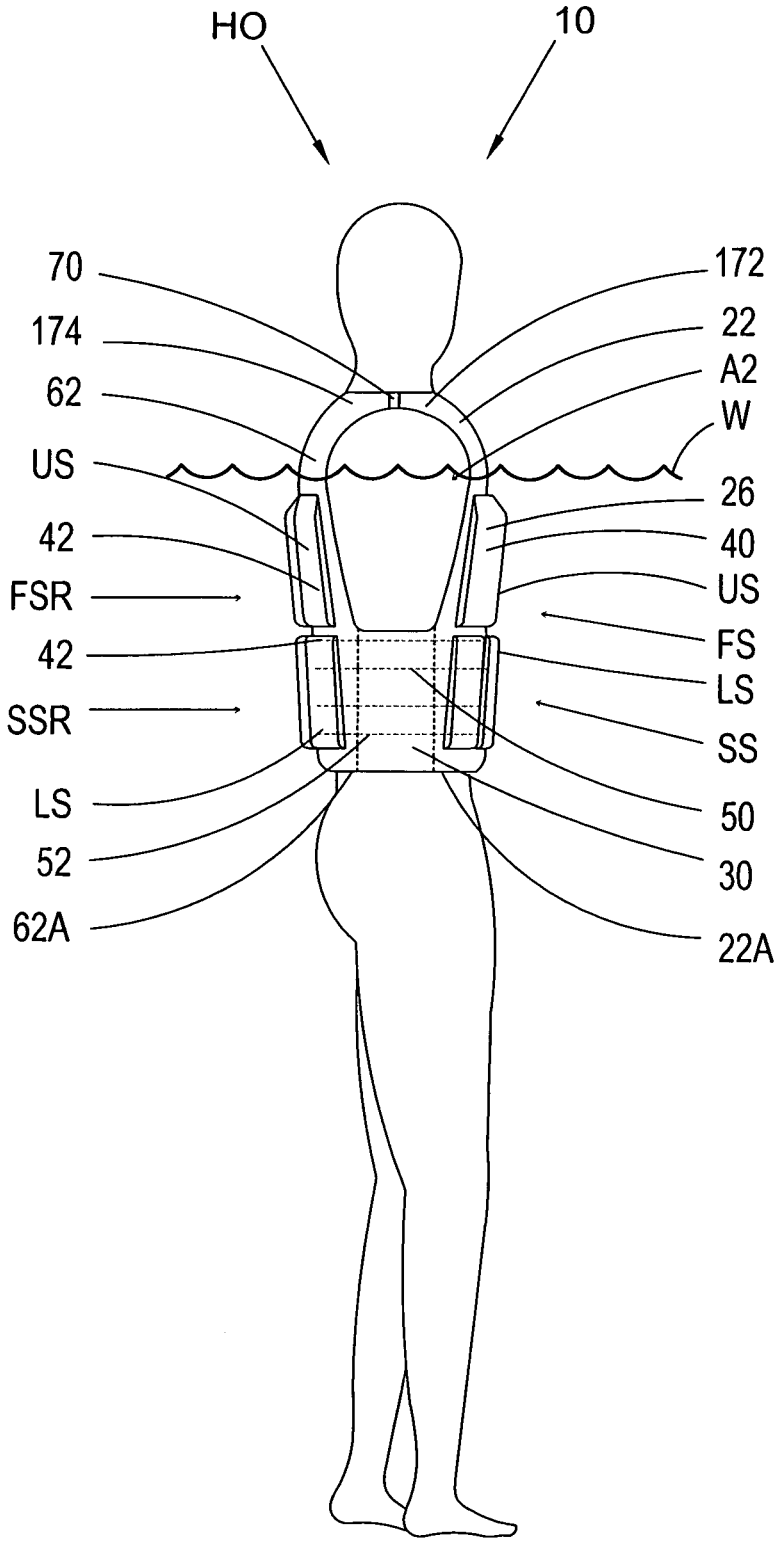
Figure 7:
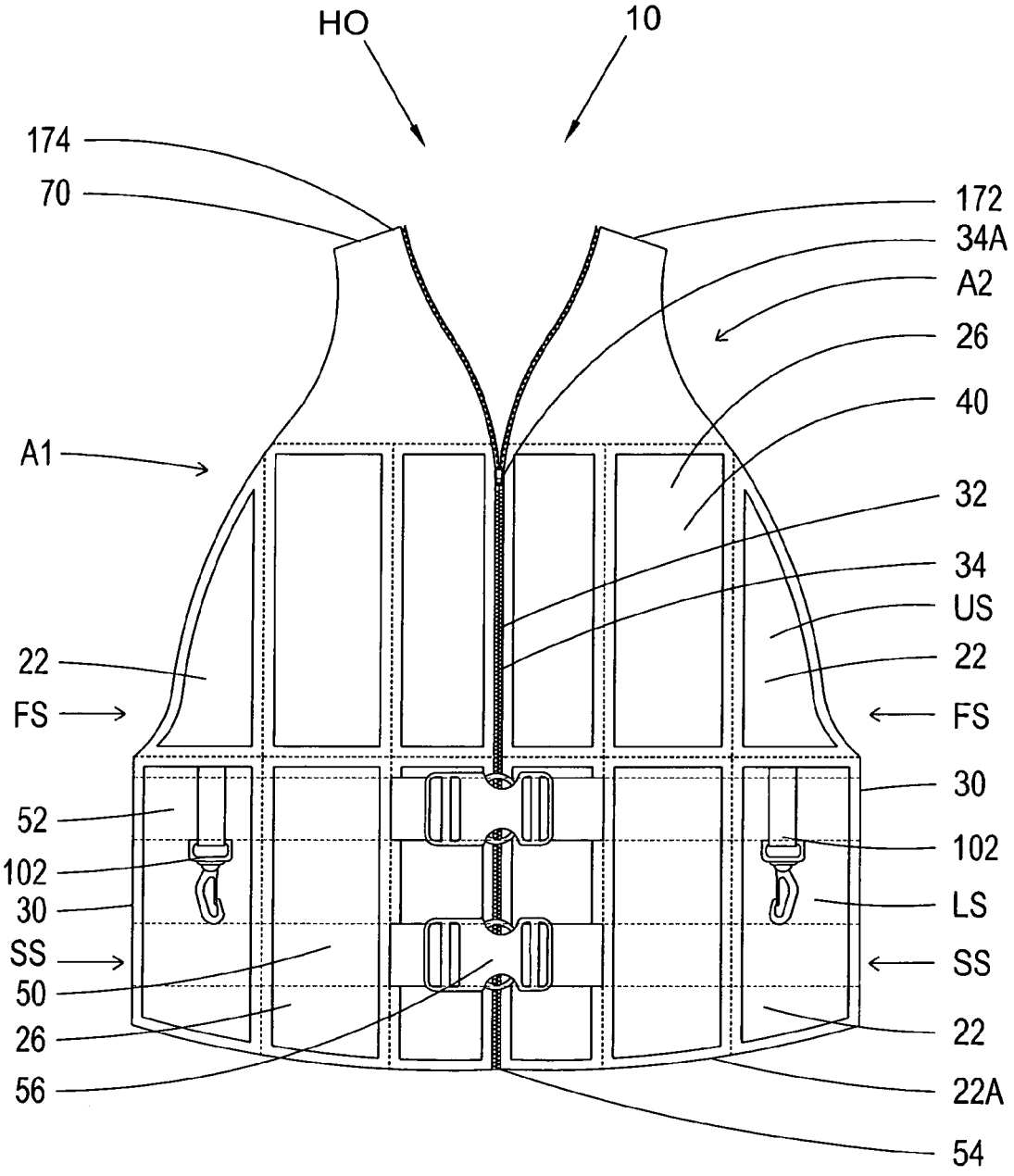
Figure 8:
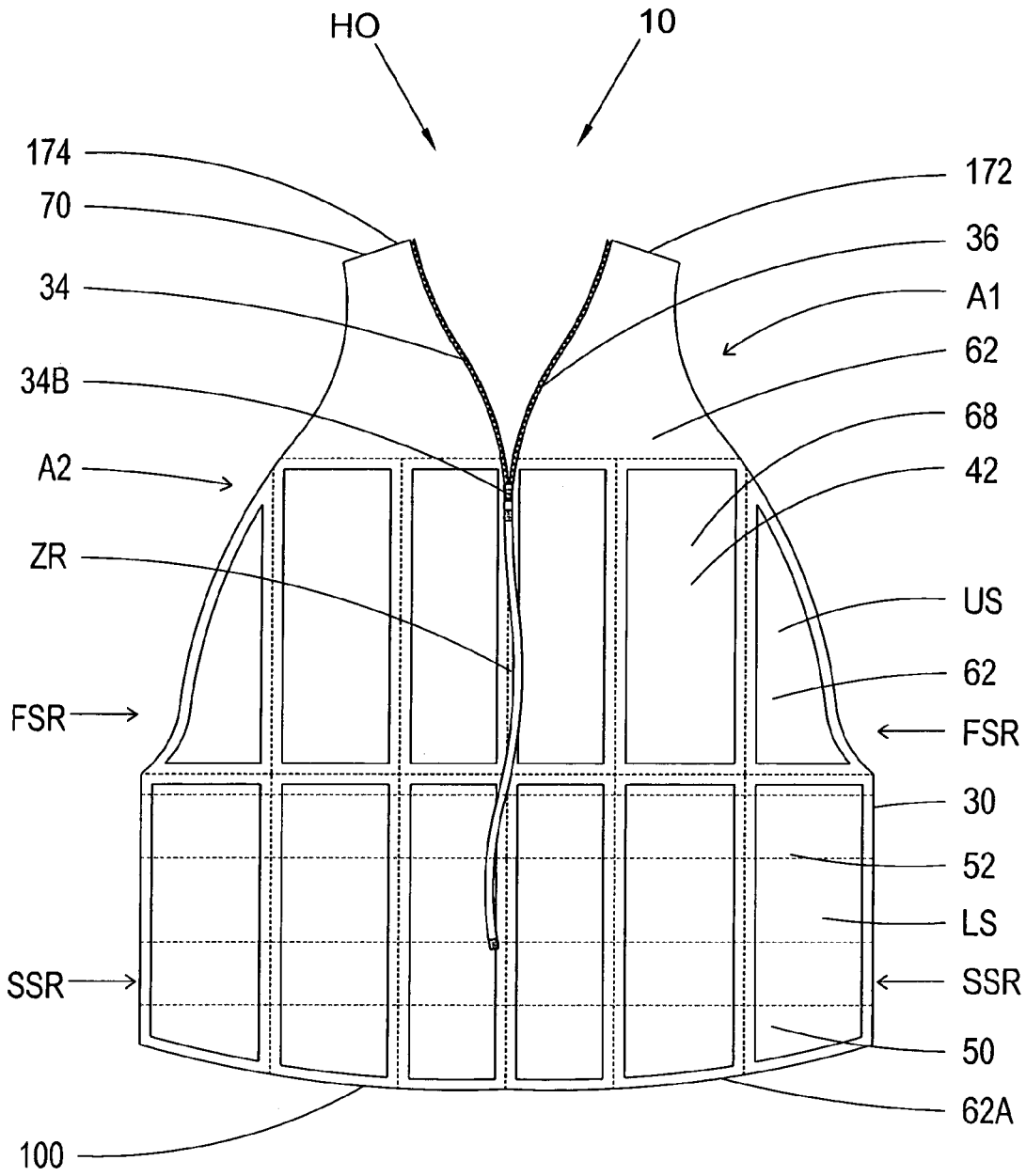
Figure 9:
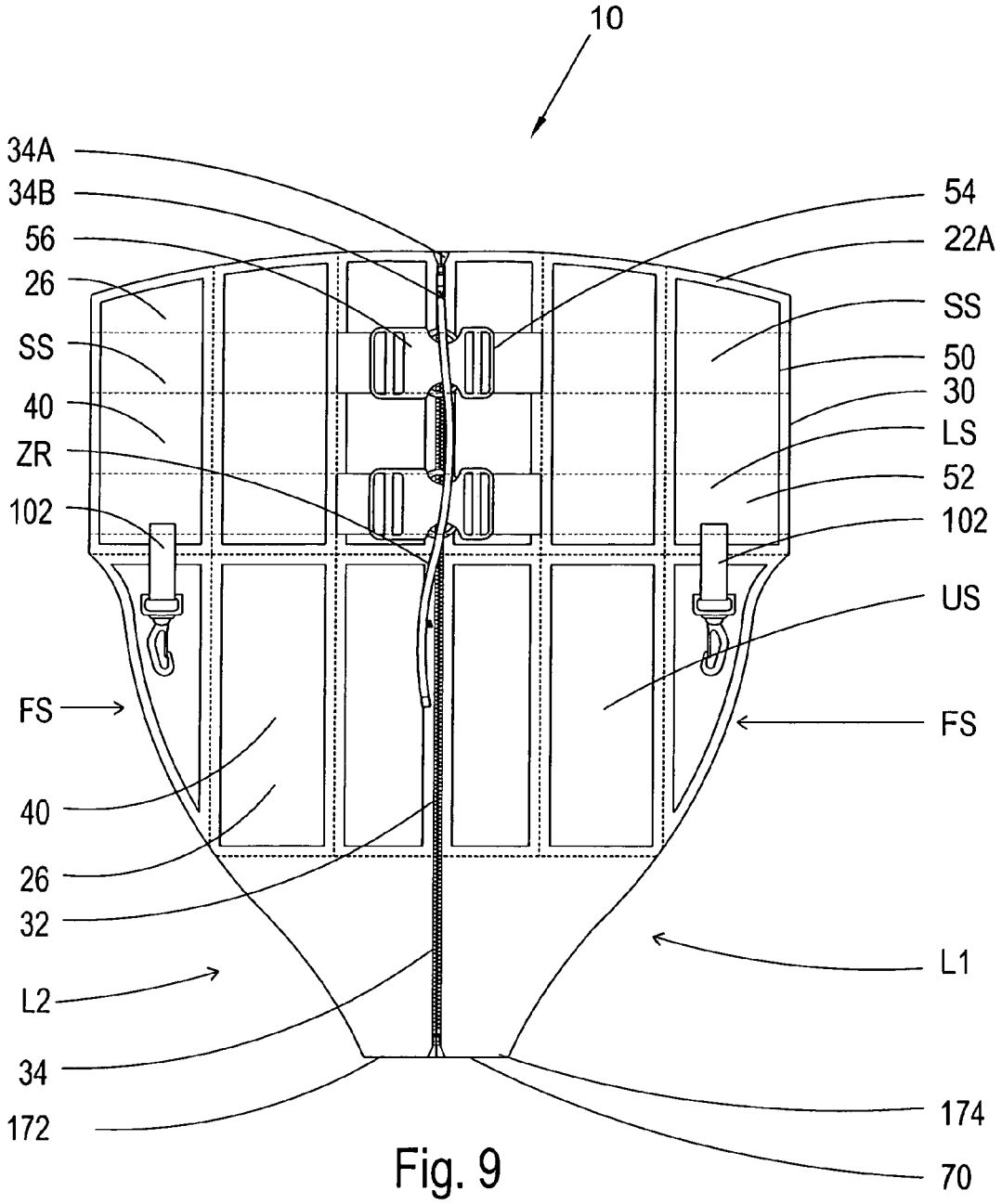
Figure 10:
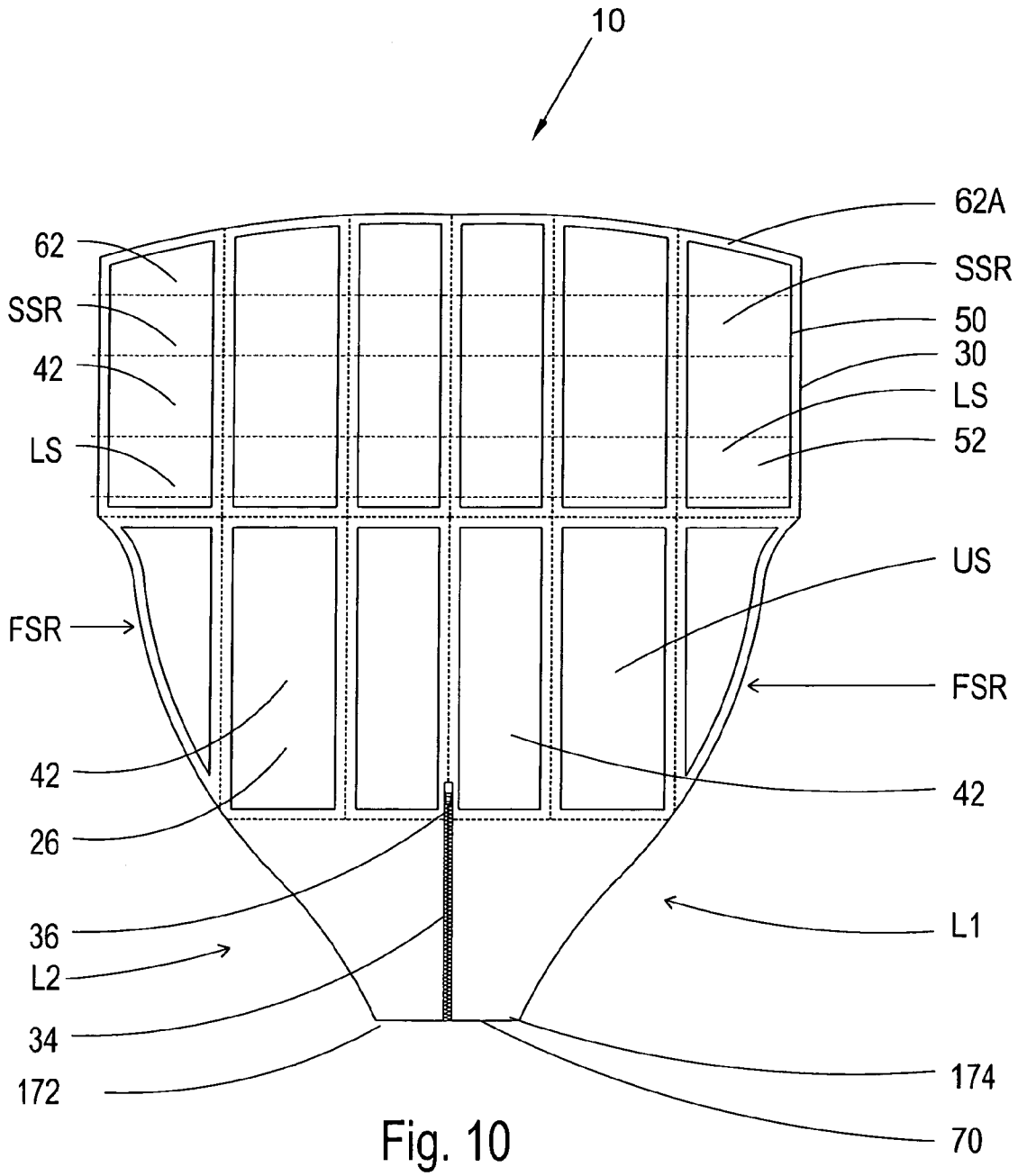
Figure 11:
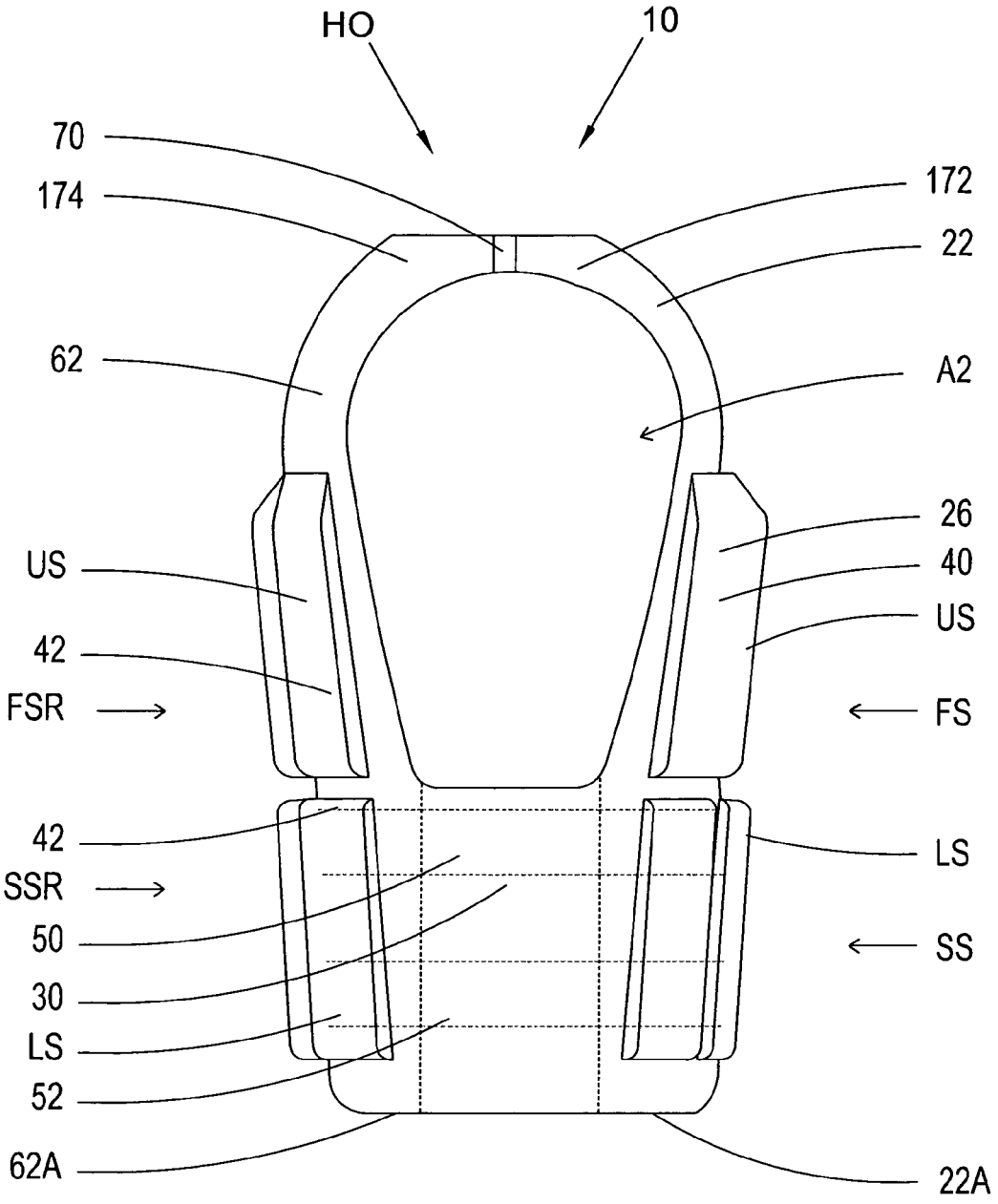
Figure 12:
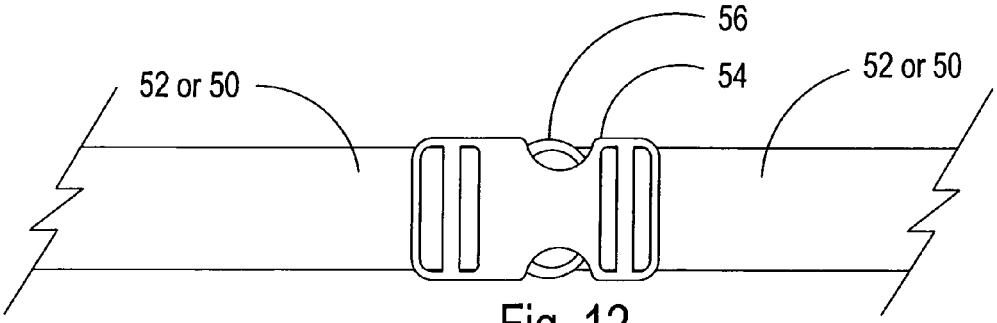
Figure 13:
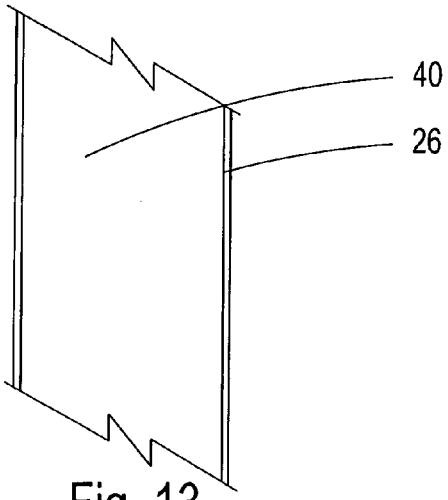
Figure 14:
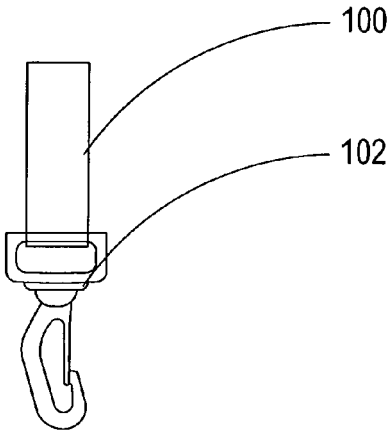

As required, detailed embodiments of the present invention are disclosed herein; however, it is to be understood that the disclosed embodiments are merely exemplary of the invention which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

Reference is now made to the drawings, wherein like characteristics and features of the present invention shown in the various FIGURES are designated by the same reference numerals.

First Preferred Embodiment

Figure 15:
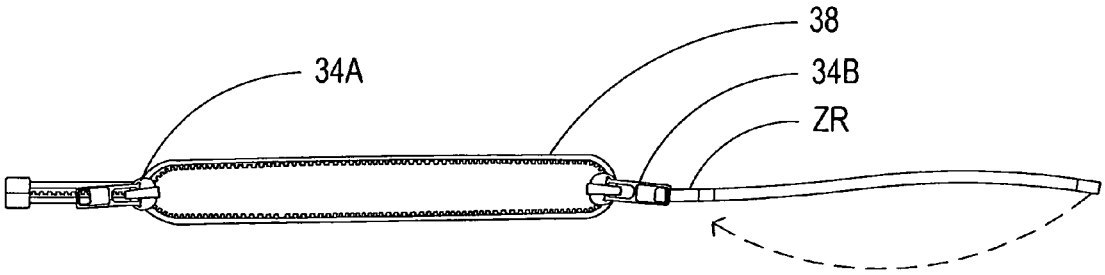
Figure 16:
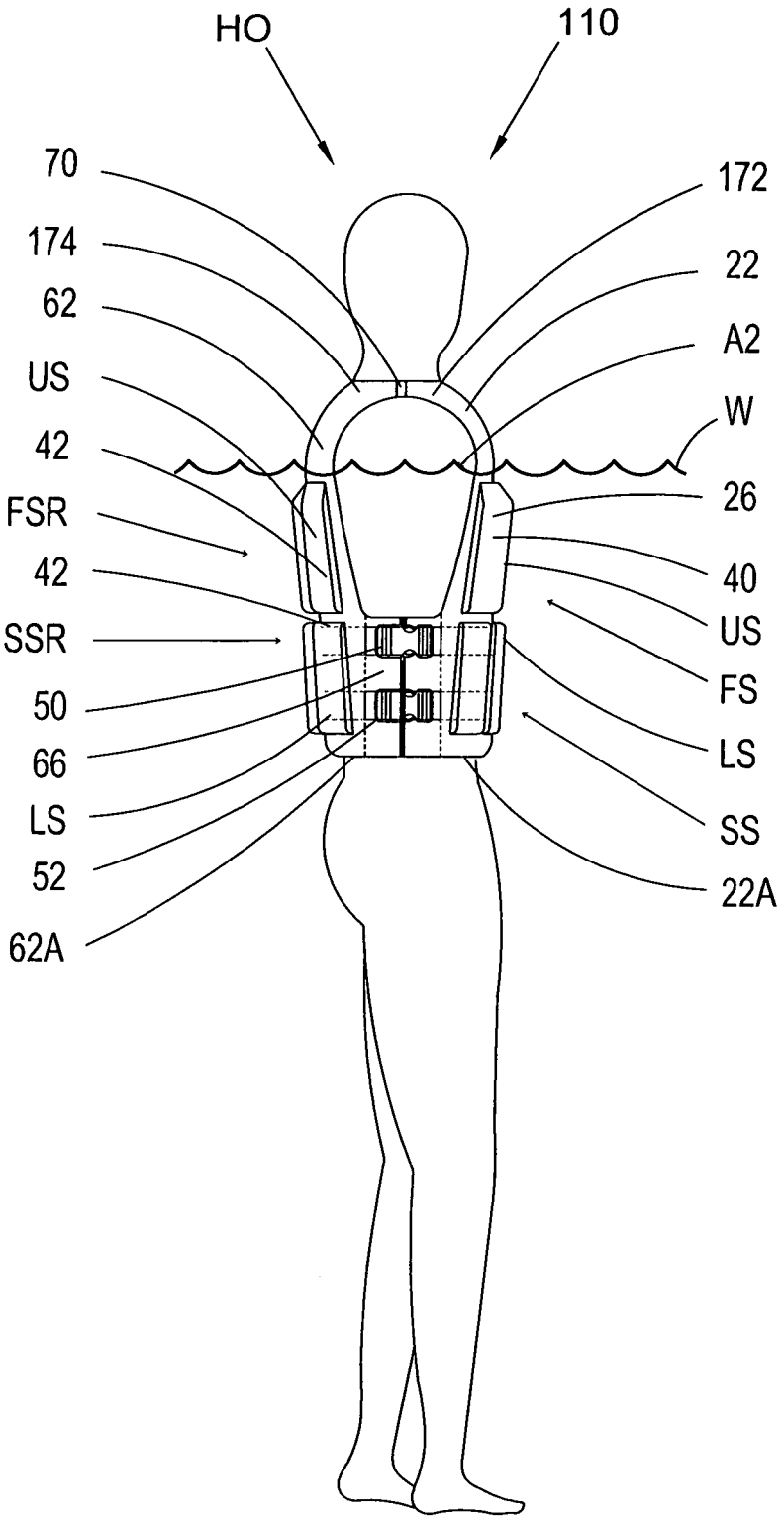

Referring to FIGS. 1-15, a floatation garment 10 is disclosed which can be worn as a pair of shorts or inverted and worn as a life vest. Garment 10 includes a garment front sheet 22 and a garment rear sheet 62 which are laterally interconnected by lateral connecting segments 30 to form a single tubular structure with a vertical axis and formed of elastic material E such as spandex for fitting around the chest or trunk of a wearer. An upright forward slit opening 32 is provided through the center of front sheet 22 to permit the garment 10 to be opened so that the wearer can take the garment 10 on and off, dividing the front sheet 22 into front sheet left portion 22L and front sheet right portion 22R, with closure fasteners such as a garment multi-directional zipper track 34 with zipper tabs 34A, as well as first and second straps 50 and 52 fastened to and wrapping around the garment 10 and having opposing strap ends meeting at the middle of the front sheet 22 and fastened with opposing and corresponding strap fasteners 54 and 56, respectively, over slit opening 32. The multidirectional zipper tabs 34A both ride in the same zipper track 34, as shown in FIG. 15, and therefore can be advanced along the track 34 either toward or away from each other.

The garment front sheet 22 has a wider forward sheet portion 22A with generally horizontal and spaced apart front first and second series FS and SS, one above the other, of front buoyant member pockets 26, each of which each contain a front buoyant member 40 the front garment sheet 22 having a slightly arched front sheet first end 22A tapering along a vertical direction to define its second end. The front sheet 22 preferably terminates between the chest and abdominal area of the wearer so that the wearer is further unrestricted in bending at the waist. The first and second series FS and SS permit the front sheet 22 to bend along a horizontal line between the series US and LS to permit the wearer to bend forward at the waist. First and second sheet straps 50 and 52, respectively, extend laterally from the front sheet 22 and have fastening mechanisms 54 and 56 such as buckles or clasps at their free ends.

The garment rear sheet 62 also has generally horizontal first and second series FSR and SSR of rear buoyant member pockets 66, one above the other each containing a rear buoyant member 42. The garment rear sheet 62 has a sheet first end 62A and tapers along a vertical direction from its second end and meets and connects to the tapered second end of the garment front sheet 22 to define in combination a connecting segment 70, on opposing sides of which are defined leg openings L1 and L2 which become arm openings A1 and A2 when the garment 10 is inverted to become a vest. Connecting segments 70 are formed of a non-abrasive fabric to prevent the garment 10 from causing brush burns on wearer hips.

Greater buoyancy is provided in the front sheet 22, to keep the wearer facing upward in the water. The upright buoyant members 40 and 42 preferably are soft foam blocks or panels such as of PVC foam. The front and rear strap connection means 54 and 56 preferably are 1.5 inch heavy duty coated nylon belts with durable quick release buckles.

As noted above, the front and rear panels 22 and 62 are laterally interconnected by connecting segments 30. Connecting segments 30 preferably are formed of neoprene or other suitable material E.

The garment zipper 34 preferably extends entirely along the upright front slit 32 in front sheet 22 and along an upright rear slit 36 extending part way down rear sheet 62. Front and rear zipper tabs 34A and 34B preferably are provided so that the front zipper tab 34A and rear zipper tab 34B can be pulled up to an extent that an open slit gap remains between the tabs 34A and 34B defining a head passing opening HO when the garment 10 is to be used in its vest mode. A zipper flap 38 preferably is secured to front sheet 22 and to rear sheet 62 along one side of front and rear slits 32 and 36 to lay laterally over the garment zipper 34 and thereby shield the wearer from abrasive contact with the zipper 34. A zipper pull ribbon ZR preferably is attached to zipper tab 34A so that the wearer can easily find, grip and pull each zipper.

Shoulder segments 172 and 174 are defined by a portion of the garment sheet between the central slit 32 a leg openings L1 or L2. Accessory connection clips 102, preferably mounted at the free ends of short clip straps 100 fastened to the garment, optionally are provided on garment 10 to connect future devices.

Method of Use

To put on floatation garment 10 as shorts, a wearer opens slit 32, placing his or her legs through leg openings L1 and L2 so that connecting segment 70 passes between the wearer legs when the garment is worn as shorts and preferably is integral with the front and rear sheets 22 and 62 to define a single, continuous garment sheet, and connects opposing strap fasteners 54 and 56. When garment 10 is inverted to become a vest, leg openings L1 and L2 become arm openings A1 and A2. Garment 10 can be used as a vest by opening the forward slit opening 32, fitting wearer arms through respective arm openings A1 and A2 and closing the garment 10 in the manner of an ordinary vest and securing the upper and lower straps 50 and 52 with strap fastening mechanisms 54 and 56, and alternatively used as trunks by inverting the garment 10 and fitting wearer legs through respective leg openings L1 and L2 and closing the garment 10 and securing the upper and lower straps 50 and 52 with end connectors 54.

Second Preferred Embodiment

For a second embodiment of floatation garment 10, buckles 54A and 56A are moved to the sides of the garment 10, so that garment 10 is readily opened into a buoyant float chair FC configuration. The zippers are also located at the sides of garment 10. See FIGS. 16-20.

Figure 17:
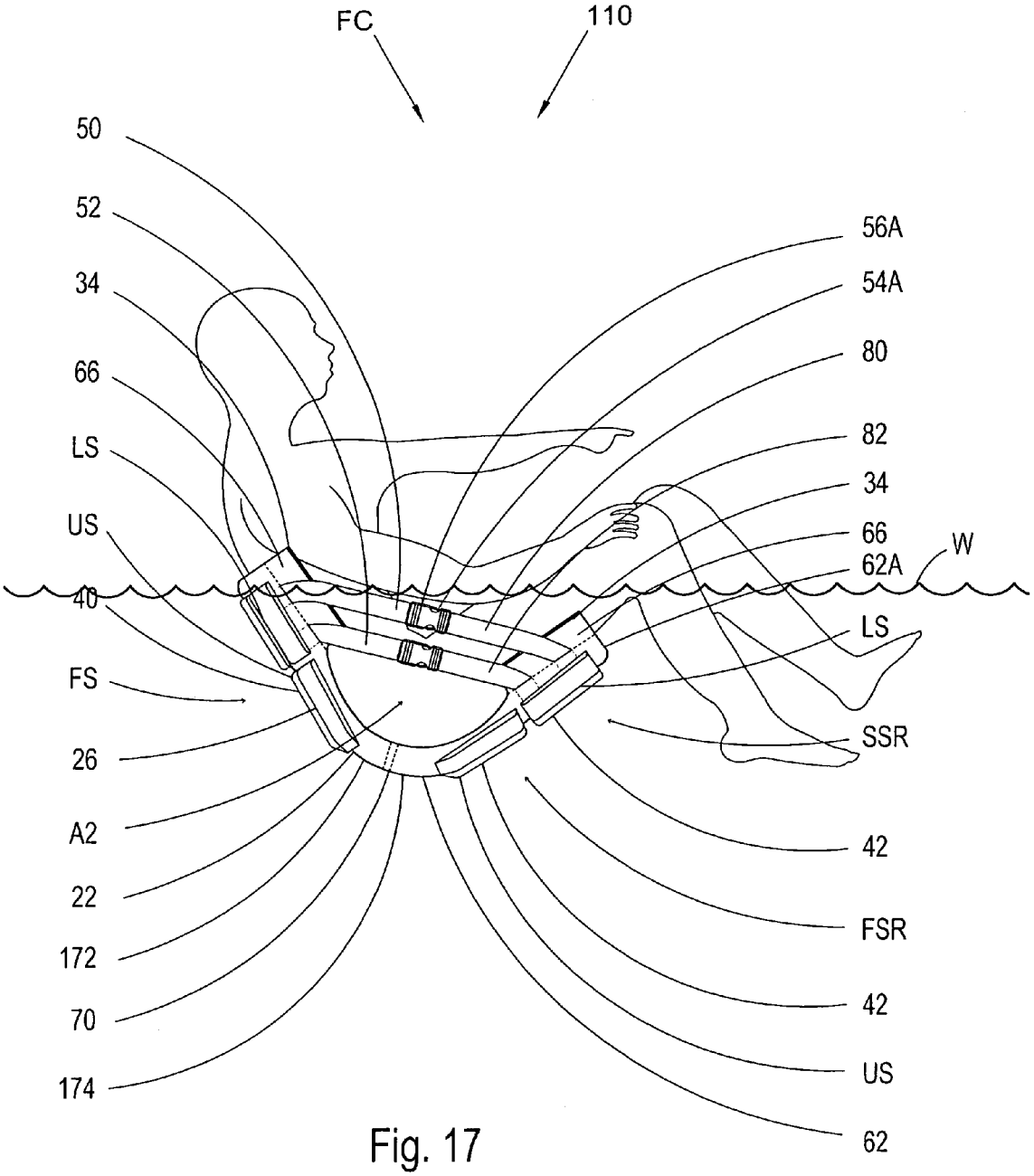
Figure 18:
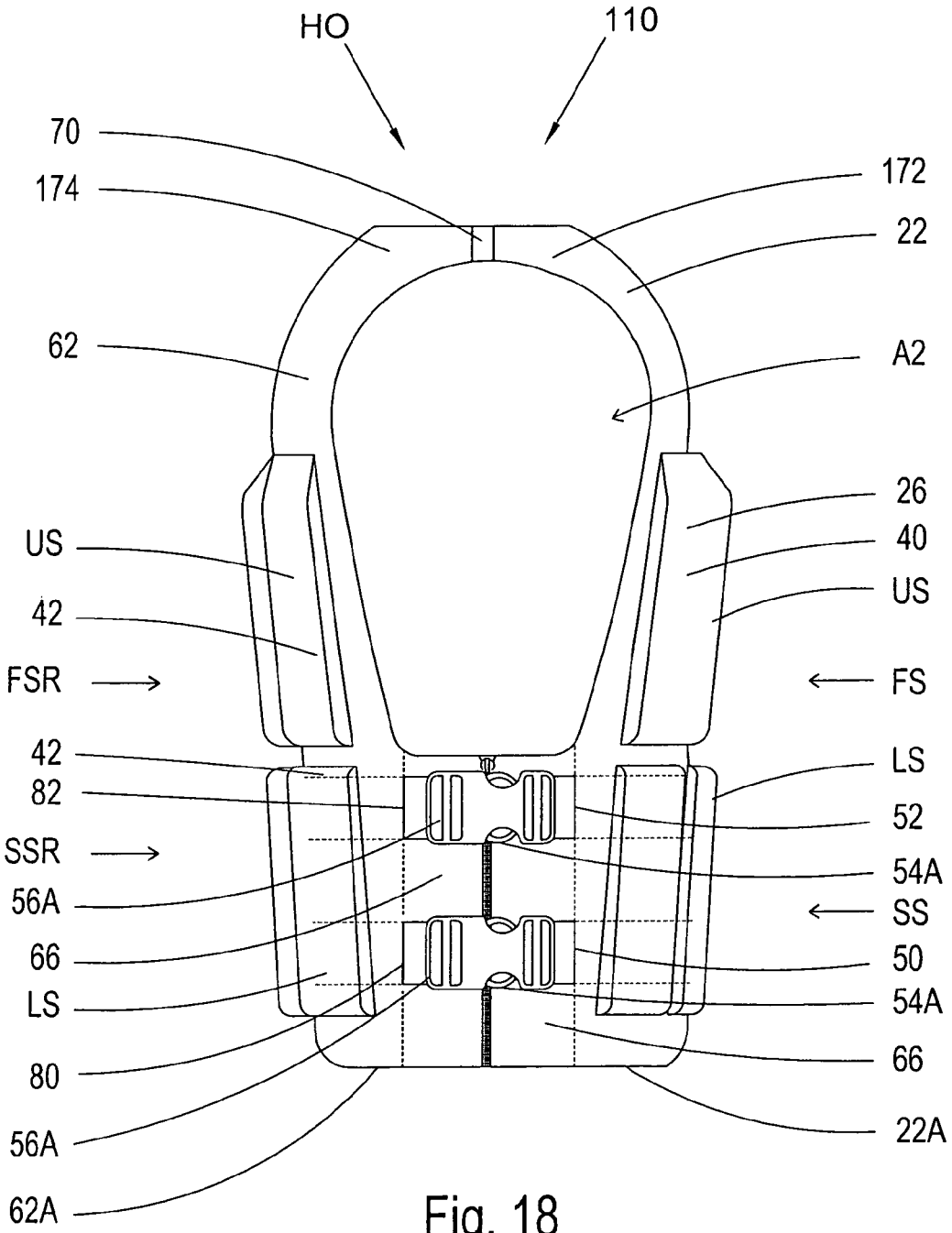
Figure 19:
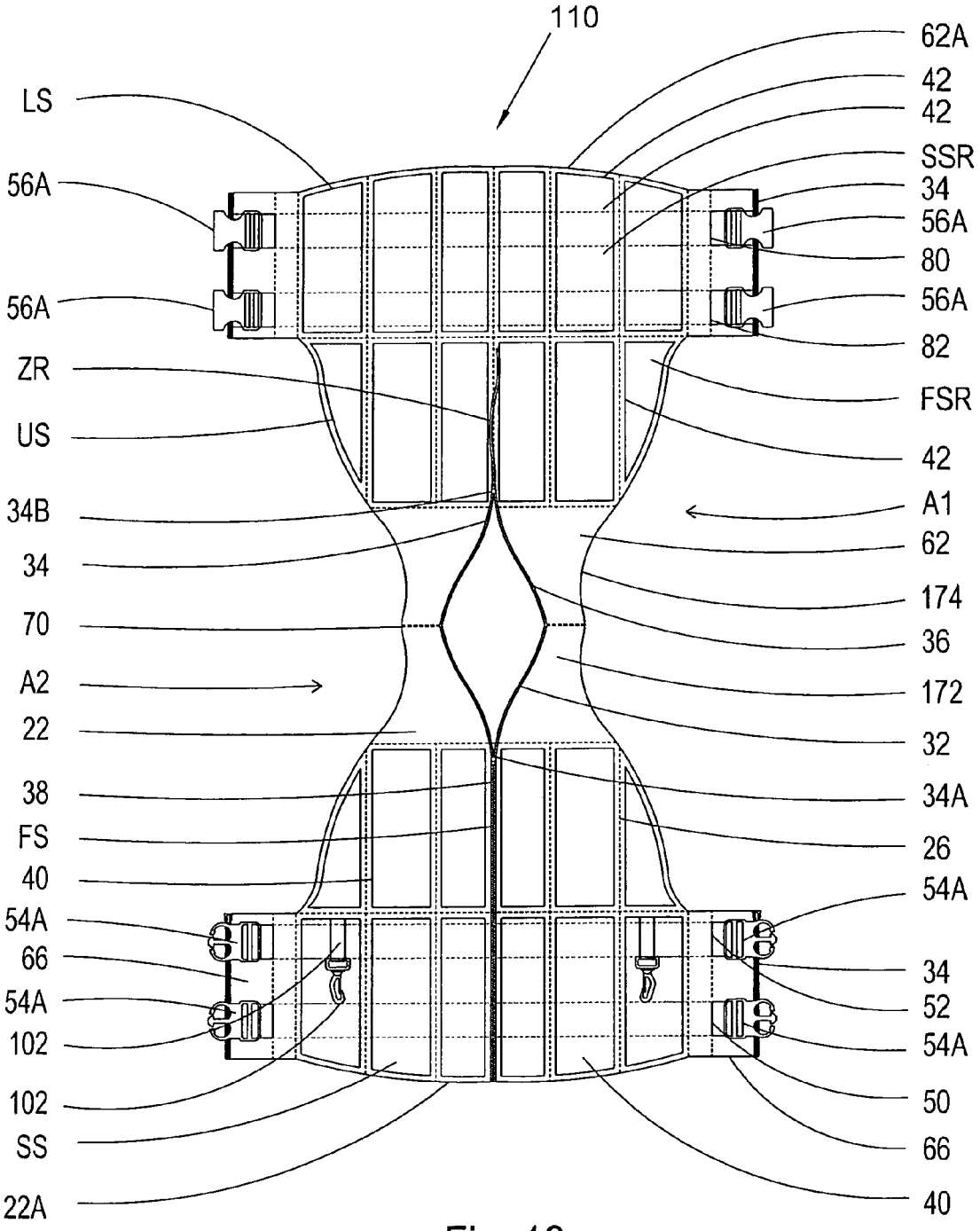
Figure 20:
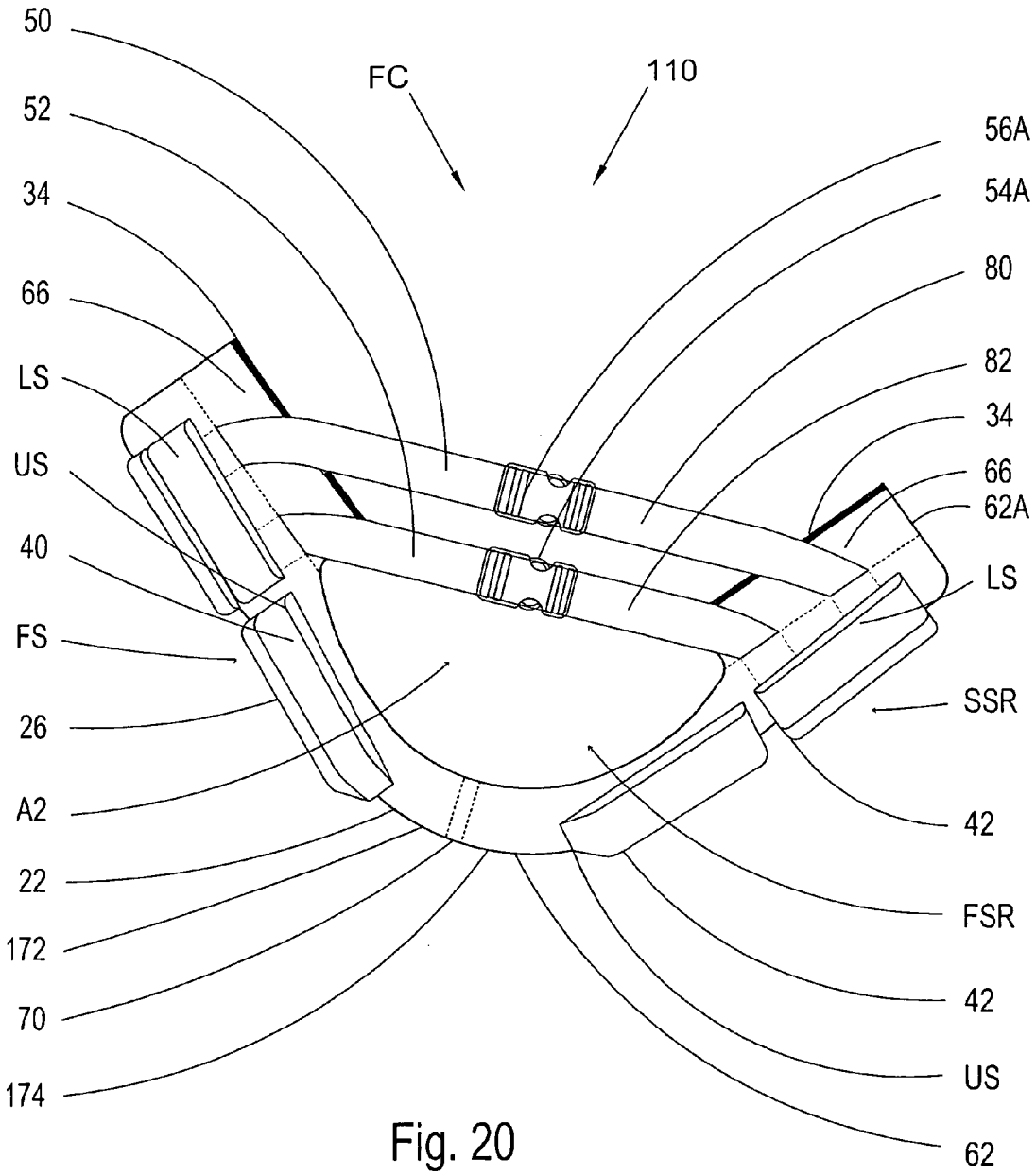

The respectively interconnected front sheet straps 50 and 52 and rear sheet straps 80 and 82 preferably are extendable by releasing an extra length of each of the straps 50 and 52 at side buckles 54A and 56A so that the garment 10 can be opened by pivoting front and rear garment sheets 22 and 62 away from each other, and the straps 50 and 52 then locked by the grip of the buckles 54A and 56A on the straps 50 and 52 at a point at which the front sheet 22 and rear sheet 62 extend substantially at 90 degrees relative to each other so that the garment 10 opens to a specific extent to define a float chair FC, as shown in FIG. 17. Alternatively, garment 10 can be opened by releasing an extra length of each of the straps 50 and 52 at side buckles 54A and 56A. A person can recline and rest in float chair FC as it floats in water W, as shown, while seated on connecting segment 70, with his or her back resting against rear garment sheet 62 and upper legs resting against front garment sheet 22. FIG. 20 shows with respect to the water line W how the chair FC floats while occupied.

It is preferred that a neoprene flap 66 be provided, preferably connected to and extending rearwardly from each lateral end of the front sheet 22, and extending entirely across the gap between the opposing lateral ends of front sheet 22 and rear sheet 62. See FIGS. 16, 18 and 20. These left and right neoprene flaps 66 shield the wearer, particularly the larger wearer, from rubbing and abrasion of the straps 50 and 52 and any resultant soreness or rash.

While the invention has been described, disclosed, illustrated and shown in various terms or certain embodiments or modifications which it has assumed in practice, the scope of the invention is not intended to be, nor should it be deemed to be, limited thereby and such other modifications or embodiments as may be suggested by the teachings herein are particularly reserved especially as they fall within the breadth and scope of the claims here appended.

We claim as our invention:

1. An invertible floatation garment which can be worn as a vest and then can be inverted to be worn as a pair of shorts, comprising:

a garment front sheet having a forward sheet portion tapering to form a garment front sheet tapered end a garment rear sheet having a rear sheet portion tapering to form a garment rear sheet tapered end and and connecting to said garment front sheet tapered end to define a connecting segment;

a buoyant member secured relative to at least one of said garment front sheet and said garment rear sheet;

a garment sheet connector releasibly interconnecting said garment front sheet and said garment rear sheet;

wherein said connecting segment has a longitudinal connecting segment slit defining opposing shoulder segments on either side of said connecting segment slit, said connecting segment slit comprising a slit fastener for opening and closing said connecting segment slit, said slit fastener thereby being operable to open said connecting segment slit to separate the opposing said shoulder segments and form a head opening for passing a wearer head when the garment is worn as a vest with said shoulder segments resting on opposing wearer shoulders, and said slit fastener additionally being operable to close said connecting segment slit to join together said shoulder segments with said connecting segment thereby becoming a single piece for passing between wearer legs when the garment is inverted and worn as a pair of shorts;

said garment is convertible into a vest by opening said slit fastener and passing the wearer head through said head opening and rests said shoulder segments on opposing wearer shoulders and pivoting said front sheet downwardly against the wearer chest and said rear sheet downwardly against the wearer back to define two arm openings on opposing sides of said connecting segment, each encompassing one of the wearer arms, and then interconnecting the corresponding said garment sheet connector, and said garment being convertible into a pair of shorts by closing said slit fastener and placing said connecting segment between wearer legs with said front sheet extending in front of the wearer and said rear sheet extending in back of the wearer, and then pivoting said front sheet upwardly against the wearer abdomen and said rear sheet upwardly against the wearer back to define two leg openings on opposing sides of said connecting segment each encompassing one of the wearer legs, and connecting the garment front and rear sheets together using the garment sheet connector.

2. The garment of claim 1, wherein said front are rear sheets are formed of a nonabrasive material.

3. The garment of claim 2, wherein said nonabrasive material comprises neoprene.

4. The garment of claim 1, wherein said buoyant members and member pockets extend in parallel and spaced apart upper and lower series;

such that upper and lower series permit said front sheet to bend along a horizontal line between buoyant members to permit a wearer to bend forward at the waist.

5. The garment of claim 1, wherein said front sheet is divided vertically into left and right front sheet portions which are releasibly joined by a sheet fastening means.

6. The garment of claim 1, wherein said connecting segment slit extends at least part way down said front sheet and at least part way down said rear sheet, and wherein said slit fastener for opening and closing said connecting segment slit comprises a garment zipper with a zipper track having at least one zipper tab for operating said garment zipper.

7. The garment of claim 6, wherein said two said zippers ride in and along the full length of said zipper track such that said zippers can be advanced toward each other and away from each other along said connecting segment slit to produce an open slit gap between said front and rear zipper tabs defining said head passing opening when the garment is used in its vest mode.

8. The garment of claim 1, wherein said front buoyant members collectively have greater buoyancy that said rear buoyant members to cause a wearer to float face upright for greater safety.

9. The garment of claim 1, wherein said front sheet terminates in a generally horizontal upper edge, and said rear sheet terminates in an outwardly arched upper edge.

10. The garment of claim 1, wherein said garment sheet connector comprises front and rear strap sheet securing straps connection means comprise buckles.

11. The garment of claim 1, additionally comprising a clip secured to one of said front garment sheet, rear garment sheet and straps for fastening various items to said garment.

12. The garment of claim 1, wherein said connecting segment slit comprises a garment front slit and a garment rear slit which meet to form a single combined slit.

13. The garment of claim 1, wherein said at least one buoyant member comprises a front buoyant member.

14. The garment of claim 13, comprising a plurality of front buoyant members.

15. The garment of claim 14, additionally comprising a series of front buoyant member pockets within each of which one of said front buoyant members is retained.

16. The garment of claim 1, wherein said at least one buoyant member comprises a rear buoyant member.

17. The garment of claim 16, comprising a plurality of rear buoyant members.

18. The garment of claim 17, additionally comprising a series of rear buoyant member pockets within each of which one of said rear buoyant members is retained.

19. The garment of claim 10, wherein said lateral fastening means comprises upper and lower sheet straps extending laterally from said front sheet and having strap fastening mechanisms at their free ends.

20. The garment of claim 10, wherein said garment sheet connector comprises upper and lower front sheet straps extending laterally from the front sheet and have fastening mechanisms at their free ends.

21. The garment of claim 10, wherein said buckles are located on the sides of the garment, such that said buckles can be released to permit the garment to be opened to define a buoyant float chair in which a user can sit, and then can be again engaged to secure the garment in the chair configuration.

* * * * *